United States Patent [19]

Pollart

[11] 4,004,444

[45] Jan. 25, 1977

[54] PIPE MAINTENANCE APPARATUS

[76] Inventor: Gary M. Pollart, P.O. Box 1558, Guymon, Okla. 73942

[22] Filed: May 12, 1975

[21] Appl. No.: 576,879

[52] U.S. Cl. ..... 72/370; 72/392

[51] Int. Cl.[2] ..... B21D 1/08

[58] Field of Search ..... 72/370, 392, 393; 29/401; 269/289 MR

[56] References Cited

UNITED STATES PATENTS

| | | | |
|---|---|---|---|
| 1,033,687 | 7/1912 | Fish | 72/392 |
| 2,205,784 | 6/1940 | Arutunoff | 72/369 |
| 2,943,386 | 7/1960 | Katz | 29/401 |
| 3,435,651 | 4/1969 | McInnis | 29/454 |
| 3,710,609 | 1/1973 | Jones | 72/392 |

*Primary Examiner*—Lowell A. Larson
*Attorney, Agent, or Firm*—William R. Laney

[57] ABSTRACT

Apparatus for removing anomalies from pipe comprising an elongated framework, an elongated carriage reciprocally mounted on said framework, means for supporting an elongated pipe section spaced over said carriage for reciprocating movement with said carriage and rotational movement about the longitudinal axis of the pipe section, means for exerting force in a radially outward direction against the internal walls of a pipe section reciprocated by said carriage into a position surrounding said force exerting means, and extensible means connected to said force exerting means facilitating reciprocal movement of said force exerting means within a pipe section positioned therearound.

23 Claims, 11 Drawing Figures

PIPE MAINTENANCE APPARATUS

BACKGROUND OF THE INVENTION

1. Field of the Invention

This invention relates to machines of the type which are utilized for removing dents and distortions from tubular pipe by mechanical pressure exerted against the internal walls thereof.

2. Brief Description of the Prior Art

As a result of the need to extend the useful service life of various types of pipe, rather than replacing damaged pipe sections with entirely new pipe, many types of apparatus have been devised for maintaining pipe by removing dents and other anomalies which may be developed in the pipe during usage, and which may impair the ability of the pipe to convey fluids efficiently. Among a number of prior patented structures which undertake to accomplish this function, and restore pipe to its undistorted dent-free condition, are those structures shown in Long U.S. Pat. No. 2,341,278, Perkins U.S. Pat. No. 2,787,763, McCown U.S. Pat. No. 2,780,122, and Priester U.S. Pat. No. 3,817,079. In the Perkins apparatus, a section of pipe from which dents and other anomalies are to be removed is moved to a position in which it surrounds a scissor type extension structure which moves semi-cylindrical forms radially outwardly against the internal walls of the pipe to press out and remove dents and distortions. The semi-cylindrical external surface of each of the forms or shoes provided in the Perkins structure for contacting and bearing against the internal walls of the pipe is formed on a radius of curvature which is larger than the radius of curvature of the pipe. Other generally similar structures which have been provided in the prior art have a similar relationship of these radii of curvature, or else provide pressure shoes or forms which are of the same radius of curvature at the external surface thereof as the radius of curvature of the internal wall of the pipe.

It is a widespread practice in apparatus of the type used for removing dents and anomalies from pipe by the radially outward movement of internally positioned shoes or anvils to actuate these shoes by means of pneumatic or hydraulic power fluids. Further, in some pipe straightening systems, carriage or conveyance subassemblies are provided for supporting long lengths of pipe and moving such pipe sections into a position around the shoes or anvils used to remove dents from the pipe.

BRIEF DESCRIPTION OF THE PRESENT INVENTION

The present invention provides an improved pipe maintenance apparatus which can be more effectively and easily employed to extricate or remove dents, bends, distortions and other anomalies from elongated pipe sections to restore the pipe to a serviceable condition. Broadly described, the apparatus of the invention comprises an elongated framework upon which is mounted a carriage which is motor driven for reciprocation on the framework. The carriage has mounted thereon, means for supporting an elongated pipe section spaced over, and extending substantially parallel to, the elongated carriage and the framework, with this supporting means including rollers for supporting the pipe section for rotation about its longitudinal axis. Means is provided for exerting a force in a radially outward direction against the internal walls of a pipe section which has been reciprocated by the carriage into a position surrounding the force exerting means, and the force exerting means is supported by extensible means connected thereto which facilitates reciprocating movement of the force exerting means within a pipe section positioned therearound.

In a preferred embodiment of the invention, the means for exerting force in a radially outward direction against the internal walls of the pipe section includes a pair of semi-cylindrical shoes which have an outer peripheral surface configured to bear against and engage a portion of the cylindrically shaped internal wall of the pipe section positioned therearound. The radius of curvature of the outwardly facing cylindrical peripheral surface of each of the shoes is significantly less in magnitude than the radius of curvature of the cylindrical internal wall of the pipe section.

An important advantage of the present invention is to permit dents and other anomalies to be removed from an elongated section of pipe without creasing or scoring the pipe along the internal wall thereof in the course of the dent removal process.

Another object of the invention is to provide a pipe maintenance apparatus which can function effectively for removing dents and other anomalies from sections of pipe having a length of up to 60 feet.

Another object of the invention is to provide a semi-automatic dent removing apparatus for use in removing dents and distortions from pipe sections, which apparatus functions effectively to move the pipe section, with a minimum of manual handling, into a position which facilitates dent removal.

An additional object of the invention is to provide a pipe maintenance apparatus which can effectively accommodate sections of pipe having a discharge gate projecting in a radial direction from the outer peripheral surface thereof, and which permits dents located anywhere around the periphery of the pipe section to be removed therefrom.

Another object of the invention is to provide a pipe maintenance apparatus which is relatively simple in construction, easy of maintenance and characterized in having a long and trouble-free life.

Other objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCTRIPTION OF A PREFERRED EMBODIMENT OF THE INVENTION

Figure 1:
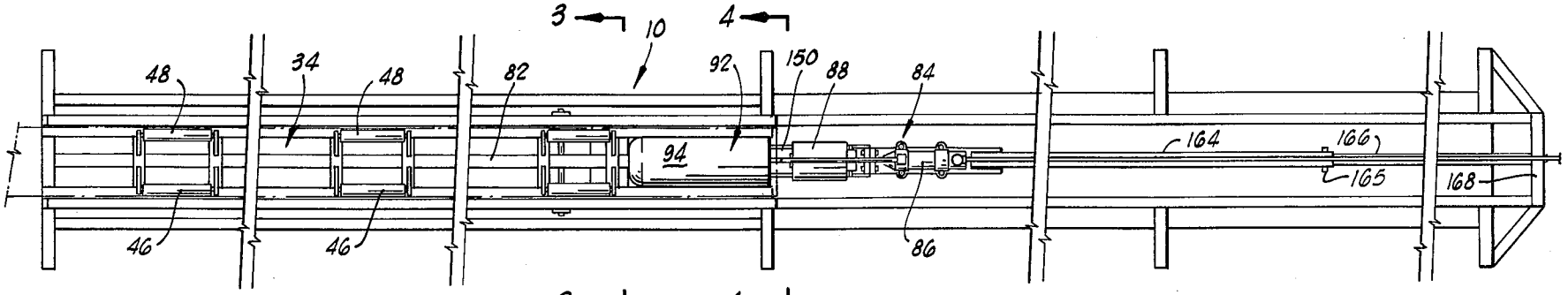
FIG. 1 is a plan view of the pipe maintenance apparatus of the invention, with parts of the structure being broken away to facilitate illustration of the overall structure.
Figure 2:
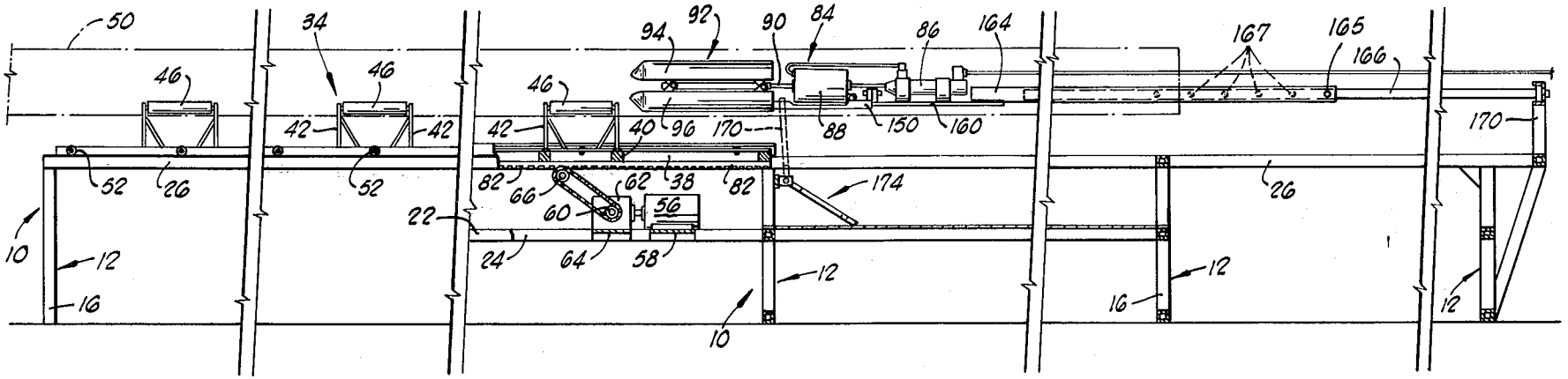
FIG. 2 is a side elevation view of the pipe maintenance apparatus of the invention with parts of the structure broken away to facilitate illustration of the apparatus.
Figure 3:
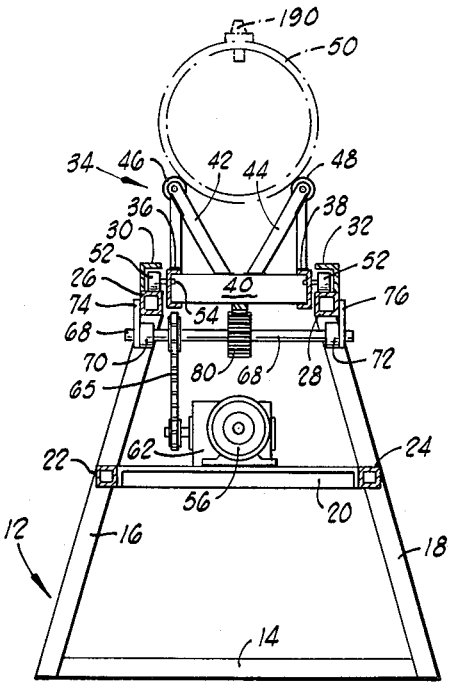
FIG. 3 is a sectional view taken along line 3—3 of FIG. 1.
Figure 4:
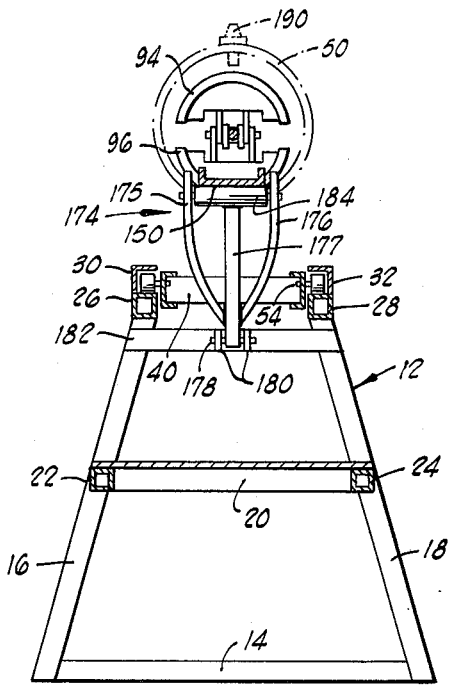
FIG. 4 is a sectional view taken along line 4—4 of FIG. 1.

Referring initially to FIGS. 1 and 2 of the drawings, the pipe maintenance apparatus of the invention comprises an elongated framework designated generally by reference numeral 10, which framework includes a plurality of vertically extending, horizontally spaced supporting frames 12. Each of the supporting frames 12 includes, as shown in FIGS. 3 and 4, a horizontally extending support runner 14, and two vertically extending stanchions 16 and 18. An intermediately positioned, horizontally extending angle brace 20 interconnects the midportions of the vertically extending stanchions 16 and 18 of the three centrally located frames 12. Interconnecting the several vertically extending support frames 12 at points in alignment with the horizontally extending angle braces 20, are a pair of elongated stringer members 22 and 24. A pair of horizontally spaced, horizontally extending elongated tubular members 26 and 28 are secured across the top ends of the vertically extending stanchions 16 and 18, respectively, and function to interconnect the several vertically extending supporting frames 12. The tubular members 26 and 28 are of square cross-section and thus present an upwardly facing track surface at the upper side thereof. Each of the tubular members 26 and 28 extends the length of the framework 10, as do the elongated stringer members 22 and 24.

A retainer trackway for accommodating a portion of a reciprocating carriage is formed by the cooperation of a pair of elongated angle members 30 and 32 which have one flange thereof welded to the outer side edges of the respective horizontally extending tubular members 26 and 28 so as to define with these tubular members, a pair of track channels opening toward the central portion of the framework 10. The angle members 30 and 32 extend over only about five feet of the framework 10, just to the left of the center of the framework.

A reciprocably mounted carriage is movably mounted on the framework 10, and is designated generally by reference numeral 34. The carriage 34 is best illustrated in FIGS. 1–3 and includes a pair of horizontally spaced, horizontally extending channel members 36 and 38 which are interconnected by a plurality of horizontally spaced, transversely extending hars 40 to form a carriage framework. Projecting upwardly from a plurality of the transverse rods 40 in divergent fashion with respect to each other are a pair of roller supporting brace members 42 and 44. A pair of horizontally extending, horizontally spaced rollers 46 and 48 are extended between the upper ends of adjacent pairs of roller supporting brace members 42 and 44 in the manner illustrated in FIGS. 1–3 of the drawings. The rollers 46 and 48 are each mounted for rotation about a horizontal axis, and the paired rollers function as supports for an elongated pipe section having a diameter greater than the distance between the paired rollers. A pipe section of the type described is illustrated in dashed lines in FIGS. 2, 3 and 4 and is designated generally by reference numeral 50. It will be noted in referring to FIGS. 1 and 2 that the carriage 34 includes three pairs of the rollers 46 and 48, which pairs are horizontally spaced along the carriage to provide adequate subjacent support for an elongated pipe section which, in one embodiment of the invention, may be as long as sixty feet.

In order to movably mount the carriage 34 on the track formed in part, by the angle members 30 and 32 and by the upper sides of the horizontally extending tubular members 26 and 28, a plurality of carriage supporting rollers 52 are mounted outside the channel members 36 and 38, and are rotatably supported on horizontally projecting stub axles 54 which are secured to the web portions of the latter channel members. The carriage 34 is driven in reciprocation on the framework 10 by means of a reversible electric motor 56 which is mounted on a transverse plate 58 secured between the elongated stringer members 22 and 24. The motor 56 drives a drive sprocket 60 through a gear box 62 supported on a transverse plate 64 secured at its opposite ends to the stringer members 22 and 24. A chain 65 from the drive sprocket 60 drives a sprocket 66 keyed to shaft 68 (see FIG. 3) which is journaled for rotation in journal blocks 70 and 72 secured to the lower portions of a pair of downwardly projecting plates 74 and 76 welded to the outer sides of the tubular members 26 and 28. At the central portion of the shaft 68, a pinion gear 80 is mounted and drivingly engages the teeth of an elongated rack 82 secured to the underside of the transverse bars 40 of the carriage 34.

A force exerting means utilized for removing dents and other anomalies from a pipe section being restored by use of the apparatus of the present invention is designated generally by reference numeral 84. The force exerting means 84 includes a pneumatic valve 86 and a pneumatic cylinder 88 having a piston rod 90 extensible therefrom and connected at its outer end to an expandable shoe subassembly designated generally by reference numeral 92. The expandable shoe subassembly is best illustrated in FIGS. 5–9, and includes a pair of cooperating, semi-cylindrical shoes 94 and 96, each of which is generally shaped as a segment of a cylinder having a closure plate (**94*a* and 96*a*, respectively) disposed at one end thereof, and partially closing this end of the shoe. At its other end, each of the cylinders 94 and 96 includes a tapered or arcuate facing plate, with these plates being designated by reference numerals 94*b* and 96*b***, and being illustrated in FIGS. 5–8.

Figure 8:
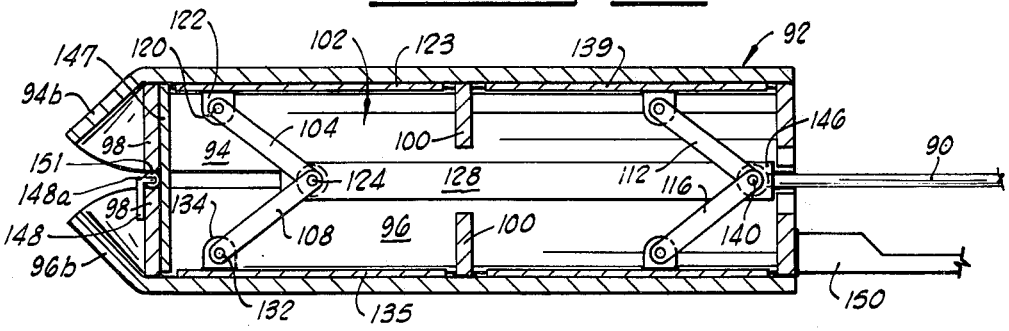
FIG. 8 is a sectional view similar to FIG. 7 but illustrating the scissors mechanism in its retracted, non-expanded status.

A transverse reinforcing plate 98 projects across the interior of each of the semi-cylindrical shoes 94 and 96 adjacent the end thereof carrying the respective arcuate facing plate **94*b* or 96*b*, and an additional reinforcing plate 100 is provided at a central portion of each of the shoes 94 and 96. It will be noted that the transverse dimension of each of the reinforcing plates 100** is limited so that the radially inner edges of these plates are spaced from each other when the shoes are in their proximal collapsed or retracted position as shown in FIG. 8. This spacing allows clearance for a portion of a scissors expansion mechanism designated generally by reference numeral 102.

Figure 7:
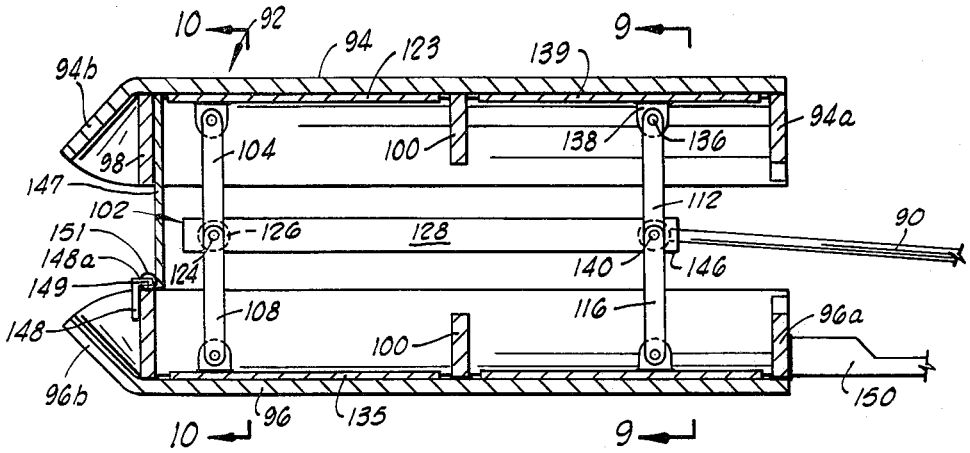
FIG. 7 is a sectional view taken longitudinally through the force exerting shoes forming part of the apparatus of the invention, and illustrating in side elevation, the scissors mechanism employed for expanding the shoes, as this mechanism appears in its expanded status.
Figure 9:
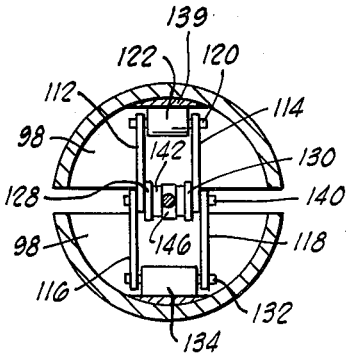
FIG. 9 is a sectional view taken along line 9—9 of FIG. 7.

The scissors expansion mechanism 102. illustrated in FIGS. 7–9, includes a pair of forward upper scissor legs 104 and 106, a pair of forward lower scissor legs 108 and 110, a pair of rear upper scissor legs 112 and 114, and a pair of rear lower scissor legs 116 and 118. The forward upper scissor legs 104 and 106 are each pivotally secured at one end to a pivot pin 120 which is journaled in a lug 122 secured to the inner side of a longitudinally extending rib plate 123 welded to the inner side of the semi-cylindrical shoe 94 at a central location therealong. The radially inner ends of the scissor legs 104 and 106 are pivotally connected to a pivot pin 124 which projects through a bore formed in a central collar 126 connected between a pair of parallel, elongated connecting bars 128 and 130 (see FIGS. 8 and 9).

In similar fashion, the forward lower scissor legs 108 and 110 have one of their ends connected to a pivot pin 132 which is journaled in a lug 134 secured to the inner side of a longitudinally extending rib plate 135 welded to the inner side of the shoe 96. The inner ends of the scissor legs 108 and 110 are pivotally connected to the pivot pin 124. The rear upper scissor legs 112 and 114 have their radially outer ends pivotally connected to a pivot pin 136 which is journaled in a lug 138 secured to the inner side of a longitudinally extending rib plate 139 welded to the inner side of the shoe 94 along the longitudinal center line thereof. The radially inner ends of the scissor legs 112 and 114 are connected to a pivot pin 140 which projects through a bore in a central collar 142. The scissor legs 116 and 118 are similarly connected in the expandable shoe subassembly.

The connecting bars 128 and 130 are secured to the collar 142 to provide a driving connection between the two pairs of forward scissor legs 104–106 and 108–110, and the two pairs of rear scissor legs 112–114 and 116–118. A clevis connection 146 is provided at the outer end of the piston rod 90 and pivotally connects the rod to the collar 142 at a central portion thereof. It will be noted in referring to FIGS. 4, 7 and 8 that a central portion of the end plates 94*a* and 96*a* is relieved to enable the piston rod 90 to be extended between these plates at a time when the shoes 94 and 96 are in their collapsed or non-expanded status.

In order to assure that the shoes 94 and 96 will open apart from each other by a directly divergent movement in which the shoes remain substantially parallel and move in a direction substantially normal to the longitudinal axis of each, a guide plate 147 is secured inside the shoe 92 and against the internal side of the transverse reinforcing plate 98 as shown in FIG. 8 of the drawings. The guide plate 147 projects downwardly into the interior of the lower shoe 96 adjacent the bottom side thereof, and is in close proximity to the inside surface of the transverse reinforcing plate 98 which projects transversely across the shoe 96.

Secured to the opposite side of the transverse reinforcing plate 98 in the lower shoe 96 from that side of this plate which is adjacent the guide plate 147 is a small roller supporting plate 148. The roller supporting plate 148 is welded to the side of the transverse reinforcing plate 98 in the lower shoe 96, and has a pair of bent ears or lugs 148*a* and 148*b* which receive a pivot pin 149 used for supporting a roller 151 positioned in a slot or relief formed in the center of the transverse reinforcing plate 98 disposed transversely across the lower shoe 96. The roller 151 bears against the surface of the guide plate 147 as the shoes 94 and 96 move divergently from each other, and this tracking movement assures that the shoes will move directly apart from each other, and will remain parallel during their expanding movement.

Figure 11:
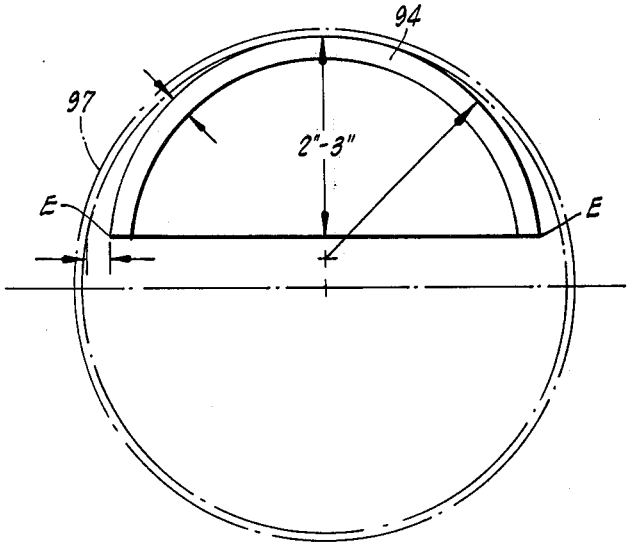
FIG. 11 is a schematic view illustrating the dimensional relationship between one of the force exerting shoes utilized in the apparatus of the present invention, and a pipe section positioned around the force exerting shoes.
Figure 10:
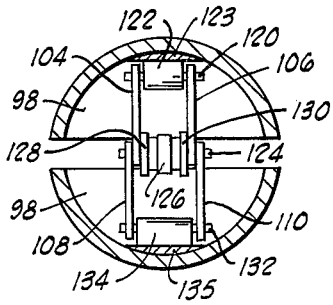
FIG. 10 is a sectional view taken along line 10—10 of FIG. 7.

Before departing from a discussion of the expandable shoe subassembly 92, the construction of the semi-cylindrical shoes 94 and 96 to provide an important dimensional relationship to the pipe section to be restored by the use of the apparatus of the invention will be discussed. Referring to FIG. 11 of the drawings, the semi-cylindrical shoe 94 is there schematically illustrated, and there is shown surrounding this shoe and portrayed in dashed lines, a cross-sectional view of a pipe section 97. I have determined that in order for the apparatus of the invention to perform effectively and optimally in removing dents and other anomalies from tubular members, and particularly, relatively thin-walled pipe sections, it is necessary that the shoes employed in the expandable shoe subassembly 92 have their outer peripheries formed on radii of curvature which are smaller than the radius of curvature of the pipe section to be processed if creasing or crimping of the pipe section along a longitudinal line extending substantially parallel to the axis of the pipe section is to be avoided. Such crimping or creasing appears to occur with thin-walled pipe when the shoes are made of an equivalent or larger diameter (and thus of equivalent or larger radii of curvature at the outer periphery thereof) than the pipe section placed thereover during the dent removal operation.

One of the most useful applications of the apparatus of the invention is in the removal of dents and anomalies from thin-walled, aluminum irrigation pipe used for irrigating large fields. Typically, this pipe may have an outside diameter of 7, 8 or 10 inches and the pipe thickness is typically 0.051 inch. With pipe of this type, as well as with some thicker pipe sections, it is desirable to form each of the shoes 94 and 96 on a radius of curvature such that the bounding side edges E of each shoe (see FIG. 11 of the drawings) are each spaced inwardly a distance of about 0.25 inch from the adjacent internal wall surface of the surrounding pipe to be straightened or restored, as such dimension (E) is measured along a line extended through a point radially displaced from the center of curvature of the shoe, and located from two to three inches radially inwardly from the internal wall of the pipe as measured on a radius thereof (see FIG. 11). Stated in another way, the construction of each of the shoes 94 and 96 is based on a shoe geometry which is arrived at by initially measuring radially inwardly from the internal wall of the pipe by a distance of from two inches to three inches (increasing from two inches in the case of 7 inch outside diameter pipe, to three inches in the case of 10 inch outside diameter pipe), then drawing a line through this point measured radially inwardly from the internal wall of the pipe, with this line extending parallel to a line of diameter of the pipe, and normal to the radius upon which the inward measurement described is made, then placing two points on the line thus drawn, with each of these points being spaced a distance of one-quarter inch inwardly along the line from the point where the line intersects the walls of the pipe. These two points, along with the point of intersection of the described radius line with the internal pipe wall, are then used to determine the arc which is drawn to establish the radius of curvature of the shoe which is to be constructed for use in a pipe section of the described outside diameter.

The advantage of constructing the semi-cylindrical shoes 94 and 96 in the manner described is that when these shoes are biased apart from each other by expansion of the expandable shoe subassembly 92 in a manner hereinafter described, and the paired shoes are forced against the internal wall of the pipe section, a smooth rounded surface is presented for contact with the internal surface of the pipe at all points where contact is established, and the internal wall of the pipe does not encounter any well defined sharp edges, such as the edges E which are always spaced from the internal wall of the pipe section.

Figure 5:
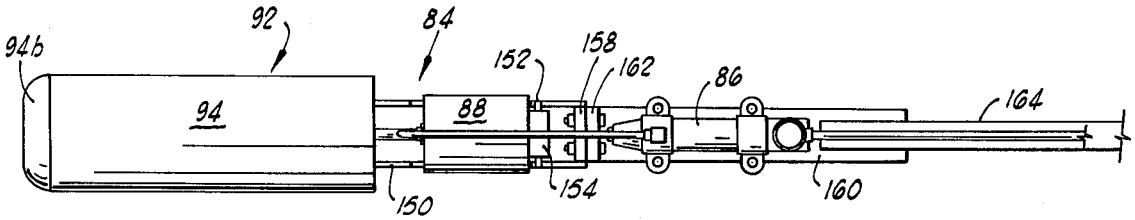
FIG. 5 is a plan view illustrating in greater detail, the force exerting means used in the apparatus of the present invention for exerting a radially outwardly directed force against the internal walls of a pipe section positioned around the force exerting means.
Figure 6:
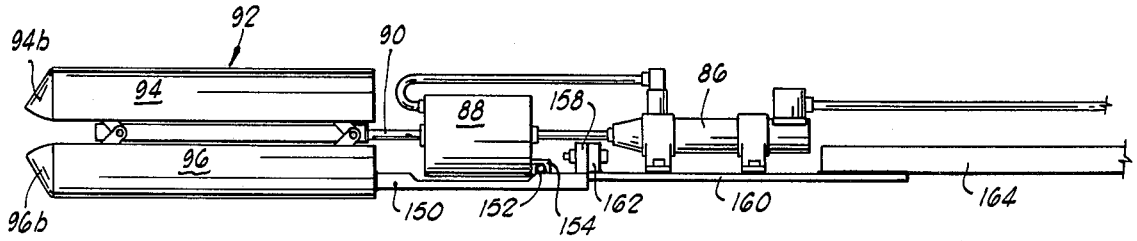
FIG. 6 is a side elevation view of the pressure exerting apparatus illustrated in FIG. 5.

For the purpose of retaining the semi-cylindrical shoes 94 and 96 in fixed position relative to the pneumatic cylinder 88, an elongated channel 150 is secured to the end plate 96*a* at a position to provide significant clearance from the piston rod 90, and extends rearwardly from the semi-cylindrical shoes 94 and 96. Intermediate the length of the elongated channel 150, the pneumatic cylinder 88 is pivotally connected thereto by means of a transverse rod 152 which projects across the rear side of the cylinder adjacent the lower portion thereof, and is pivotally received in a U-shaped bracket 154 which is welded or otherwise suitably secured to the rear side of the cylinder 88. The bar 152 is welded at its opposite ends to the upper edges of the channel 150 as best shown in FIGS. 5 and 6 of the drawings. The cylinder 88 is thus free to pivot about a horizontal axis which coincides with the axis of the transverse rod 152, and thus the oscillating up and down movement undergone by the piston rod 90 upon extension and retraction is accommodated as may be needed at these times to permit changes in the operating positions of the semi-cylindrical shoes 94 and 96.

At its rear end, the elongated channel 150 has an upwardly projecting connection plate 158 secured thereto to facilitate the ease with which the cylinder 88 and the shoes 94 and 96 can be detached from the apparatus and replaced by shoes of differing sizes, and larger or smaller cylinders, all as may be needed with pipes of varying sizes and thicknesses. The upwardly extending connection plate 158 has bolt-receiving apertures formed therein to enable such detachment and replacement. For the purpose of supporting and mounting the air valve 86 in the force exerting means 84, a flat mounting plate 160 having apertured, bolt-receiving ears formed therealong is provided, and has the air valve 86 bolted to the upper side thereof. The mounting plate 160 has secured to the forward end thereof, an upstanding connection plate 162 which has bolt apertures therein adapted to register with the bolt apertures in the connection plate 158 carried on the rear end of the elongated channel 150. Thus, the mounting plate 160 which supports the air valve 86 can be detachably connected to the forward portion of the force exerting means 84 by bolting the upwardly projecting connection plates 158 and 162 to each other. The purpose of this arrangement will be subsequently explained herein.

The end of the mounting plate 160 opposite its end which carries the upwardly projecting connection plate 162 is secured to one end of an elongated tubular sleeve 164 which has a rectangular cross-sectional configuration. The tubular sleeve 164 contains a plurality of horizontally spaced, aligned apertures 165 and telescopingly receives a stinger rod 166 which has its free, unsleeved end secured to a transverse anchor bar 168 which is mounted between the upper ends of a pair of upright members 170 disposed at the end of the framework 10 opposite the end portion thereof which carries the carriage 34. The stinger rod 166 is pinned in an adjustable, selected position in the sleeve 164 by means of a removable pin 167 passed through selected ones of the apertures 165. The upright members 170 are welded to the upper ends of incline, vertical members 172 forming an end of the framework 10.

A final element of the apparatus of the invention is a collapsible supporting yoke subassembly designated generally by reference numeral 174. The supporting yoke subassembly 174 includes a pair of arcuate or bowed side arms 175 and 176 which converge to points of securement to a rod 177. The rod 177 has a free lower end connected to a pivot pin 178 extending between horizontally spaced ears 180 which are welded to a cross-member 182. The cross-member 182 is secured to the frame 12 at a location below, and in substantial vertical alignment with, the rear portions of the semi-cylindrical shoes 94 and 96. The rod 177 is welded at its upper end to a transversely extending round shaft 184 which has its opposite ends connected to the bowed side arms. As will be noted in referring to FIG. 2 and to FIG. 4, the yoke subassembly 174 can be pivoted to an upwardly extending supporting position, in which the round shaft 184 contacts and supports the forward portion of the force exerting means 84 by contact with, and support of, the elongated channel 150 at a location just to the rear of the shoe 96. At another time during the use of the apparatus of the invention as hereinafter explained, the yoke subassembly 174 is caused to pivot downwardly to the position illustrated in full lines in FIG. 2 where it does not interfere with the pipe straightening operations carried out when a pipe section is placed over the force exerting means 84.

OPERATION

In operating and utilizing the pipe maintenance apparatus of the invention, an elongated cylindrically shaped pipe section is first placed upon the carriage 34 at a time when the carriage is reciprocated toward the left end of the elongated framework 10 (as the framework is depicted in FIGS. 1 and 2). The pipe section 50, illustrated in FIG. 2 in dashed lines, is rested upon the rollers 46 and 48 in the several roller pairs so that the pipe section can be rotated about its longitudinal axis for a purpose hereinafter described. Some pipe sections, particularly irrigation pipe sections, at times carry on the outer periphery thereof, a radially outwardly projecting spigot or discharge gate (as shown at 190 in FIG. 3), and it will be further noted by reference to this Figure and to FIG. 2 that it is possible to rotate the pipe section 50 about its longitudinal axis without the carriage 34 or the framework 10 interfering with such rotation due to contact with the spigot 190.

After resting the pipe section 50 upon the several roller pairs on the carriage 34, the motor 56 is energized in the proper direction to drive the carriage in reciprocating movement in the direction of the expandable shoe subassembly 92. As the carriage 34 moves in this direction, the open end of the pipe section passes over the expandable shoe subassembly 92 which is, at this time, supported in a horizontal position, in alignment with the opening into the pipe section, by means of the supporting yoke subassembly 170. At this time (that is, immediately prior to the entry of the expandable shoe subassembly 92 into the open end of the pipe), the yoke assembly 174 is in its upright supporting position, which is that position illustrated in dashed lines in FIG. 2 of the drawings. In this position, the transversely-extending round shaft 184 forming part of the yoke subassembly 174 bears against the underside of the elongated channel 150, and provides support for the expandable shoe subassembly 92 which is otherwise cantilevered from the tubular sleeve 164 and the stinger rod 166.

As the pipe section 50 moves over the expandible shoe subassembly 92, the yoke subassembly 174 is forced out of its supporting position and enabled to fall downwardly to the full line position shown in FIG. 2 of the drawings. At this time, the carriage 34 has been reciprocated toward the force exerting means 84, and the expandable shoe subassembly 92 is permitted to fall or drop downwardly against the lower side of the pipe section 50. When the carriage 34 has reached its limit of travel, a limit switch (not shown) may be employed to cause the motor 56 to be de-energized, stopping further movement of the carriage. At this time, or previously thereto in many cases, that portion of the pipe section 50 which is dented, or carries an anomaly which needs to be removed from the pipe section, will have been moved into a position of alignment with the semi-cylindrical shoes 94 and 96 of the expandable shoe subassembly 92.

When the dent or distortion which is to be removed from the pipe section 50 has been positioned in alignment with one of the semi-cylindrical shoes 94 or 96, the force exerting means 84 is actuated for the purpose of expanding the expandable shoe subassembly 92 and removing such dent or distortion. Preferably, the pipe section 50 is rotated so as to place the dent to be removed over the upper shoe 94 so that the operator of the apparatus can observe the straightening operation, and can deactivate the force exerting means 84 as soon as the dent has been removed. As has previously been explained, the pipe section 50 can be easily rotated completely around its longitudinal axis, since the construction of the carriage 34 will permit any spigot or nozzle 190 carried on the pipe section to be rotated about such axis without contact with, or interference by, any portion of the carriage 34. It will be noted in this respect that each of the semi-cylindrical shoes 94 and 96 is of greater length than any of the rollers 46 or 48 in the several roller pairs, so that proper positioning of that part of the pipe section 50 which carries the spigot 190 can be effected in order to permit this spigot to pass between the spaced roller pairs without displacing the dent in the pipe section from over the upper shoe 94.

It will be perceived from the discussion of the operation of the pipe maintenance apparatus of the invention as thus far described that the working of a pipe section to remove dents variously spaced along the length thereof can proceed by advancing the pipe section so that the expandable shoe subassembly 92 is projected further into the interior thereof from the advancing open end as the restoration procedure is continued. Advancement of the pipe section 50 may be effected in one of two ways to bring the dents into proper removal position over the expandable shoe subassembly 92. Thus, in some instances at least the leading portion of the pipe over about one-third to one-half of its length may be moved over the expandable shoe subassembly 92 simply by advancement of the carriage 34 to its limit of travel on the elongated framework 10. Where the dents to be removed from the pipe section are, however, in the trailing end portion of the pipe section, it then will at times be necessary to cause the expandable shoe subassembly 92 to be extended to the left as the subassembly is viewed in FIGS. 1 and 2, or, stated differently, reciprocated in the direction of the carriage 34. This is accomplished by expanding the shoes 92 and 94 to engage the inner wall of the pipe after the pipe has been advanced over the shoes for about one-third to one-half its length by movement of the carriage 34 on the framework. By the expansion of the shoes, the pipe is then locked to the expandable shoe subassembly 92. The carriage 34 is then caused to move in the reverse direction (left) by reversal of the electrical motor 56 after the pin 167 has been pulled to allow the stinger rod 166 to slide in the sleeve 164.

As the carriage 34 moves toward the left at this time, the force exerting means 84 is pulled to the left because the shoes 94 and 96 are frictionally engaged with the inside of the pipe section. This movement of the force exerting means causes the tubular sleeve 164 to slide outwardly upon the stinger rod 156 so as to increase the overall length of the telescoping structural arrangement constituted by these two elements. After the carriage 34 has been reciprocated a substantial distance to the left in this fashion, the motor is stopped and the shoes 94 and 96 are released from the engaging status by collapsing of the scissors expansion mechanism 102 and the pin 167 is reinserted in a position to interlock the sleeve 164 and the rod 166 in their new relationship. The carriage can then be reactivated by energization of the motor 56 to cause the pipe section to be adjusted by movement in either direction by a short distance so as to bring the dents near the trailing end of the pipe section immediately over the semi-cylindrical shoes for dent removal in the manner hereinafter described.

At the time that the shoes 94 and 96 of the expandable shoe subassembly 92 have been positioned internally in a pipe section 50 immediately opposite or facing a dent or distorted portion of the pipe which is to be straightened, the apparatus is then actuated to cause these shoes to exert a radially outwardly acting force on such dents or distortions to remove the dents and straighten the pipe section. Actuation of the force exerting means 84 is accomplished by throwing the air valve 86 to a position such that air enters the pneumatic cylinder 88 at a location to extend the piston rod 90 from the cylinder. Extension of the piston rod 90 causes the scissors expansion mechanism 102 to undergo an expanding movement in which the scissor legs 104–118 diverge from each other, and move from the retracted or collapsed position shown in FIG. 8 to the expanded position shown in FIG. 7.

As the shoes 94 and 96 undergo this movement, their semi-cylindrical outer peripheral surfaces are brought into contact with the internal walls of the pipe section in the geometrical relationship shown in FIG. 11 of the drawings. Thus, a portion of the respective shoes 94 or 96 which is about the center thereof, as measured from edge to edge of the shoe, bears against the internal wall of the pipe section at the location where the dent to be removed is located. The pressure exerted by the expansion of the scissors expansion mechanism 102 continues to force the shoes 94 and 96 apart from each other, and against the internal walls of the pipe, so that a dent or anomaly therein is bent outwardly to a position where the wall of the pipe section is restored to its original truly cylindrical configuration. As has been previously explained, the shape of the semi-cylindrical shoes 94 is such that the opposed free edges, E, of the shoes are spaced inwardly from the internal walls of the pipe section, and therefore do not initially bear against the pipe section to cause creasing or crimping thereof.

Upon completion of the removal of the dents which have been positioned opposite one or both of the shoes 94 and 96, the air valve 86 is thrown to the retract position in which air is admitted to the double acting pneumatic cylinder 88 at a position such that the piston disposed therein is moved within the cylinder 88 in a direction to cause retraction of the piston rod 90. Retraction of the piston rod 90 causes the scissors expansion mechanism 102 to be collapsed and returned to the position shown in FIG. 8 of the drawings. The pipe section is thereby freed for further reciprocating movement with respect to the force exerting means 84, and particularly, with respect to the expandable shoe subassembly 92 thereof. Such movement is then stopped at the time that the next dents or bends which are to be removed from the pipe section have been placed in alignment with the shoes 94 and 96.

From the foregoing description of a preferred embodiment of the invention, it will be perceived that the pipe maintenance apparatus of the invention provides a useful and highly effective system for quickly and efficiently removing anomalies of various sorts from pipe sections so as to restore completely the usefulness of such pipe sections for the purposes for which they were originally intended. Although various structures have been described in referring to the preferred embodiment of the invention illustrated in the drawings, it will be understood that various structural elements and combinations of structure can be altered or even, in some cases, deleted without departure from the basic principles of the invention. Changes and innovations of this type are therefore deemed to be circumscribed by the spirit and scope of the invention except as the same may be necessarily limited by the appended claims or reasonable equivalents thereof.

What is claimed is:

1. Apparatus for removing anomalies from pipe comprising:

an elongated framework;

a carriage reciprocally mounted on said framework;

means on said carriage for supporting an elongated pipe section over said carriage for reciprocating movement therewith; and force exerting means positioned for partial entry into the interior of a pipe section through an open end thereof as said pipe section is carried on, and reciprocated by, said carriage, said force exerting means comprising:

a pair of semi-cylindrical shoes each having an outer peripheral surface formed on a radius of curvature less than the radius of curvature of the wall of a pipe section from which the anomaly is to be removed; and means for non-manually divergently moving said shoes with respect to each other while said shoes are inside said pipe section to cause said shoes to exert a radially outwardly acting force on said pipe section by contact of the semi-cylindrical surface of at least one of said shoes with the internal wall of the pipe section.

2. Apparatus for removing anomalies from pipe as defined in claim 1 wherein said means for supporting an elongated pipe section comprises a plurality of spaced pairs of rollers each mounted for rotation about a horizontally extending axis, with said pairs of rollers mounted on said carriage for movement therewith in horizontally spaced locations over said framework and on said carriage.

3. Apparatus for removing anomalies from pipe as defined in claim 1 wherein said means for divergently moving said shoes comprises:

a scissors expansion mechanism positioned between said shoes;

a piston rod connected to one end of said scissors expansion mechanism for actuating said scissors expansion mechanism upon reciprocation of said piston rod;

a cylinder having said piston rod extending from one end thereof; and means for selectively charging a power fluid to said cylinder.

4. Apparatus for removing anomalies from pipe as defined in claim 1 and further characterized as including means facilitating reciprocation of said force exerting means along the axis of said pipe section by movement toward and away from the location of said carriage on said framework.

5. Apparatus for removing anomalies from pipe as defined in claim 1 wherein said force exerting means is cantilevered over said framework, and wherein said apparatus is further characterized in including means releasably supporting said force exerting means at a horizontal level facilitating passage of said shoes through the open end of a pipe section advanced along said framework on said carriage.

6. Apparatus for removing anomalies from pipe as defined in claim 1 and further characterized as including means mounted on said framework for selectively reciprocating said carriage therealong in either of two directions.

7. Apparatus for removing anomalies from pipe as defined in claim 4 wherein said means facilitating reciprocating movement of said force exerting means comprises:

an elongated tubular sleeve; and a stinger rod having one end portion projecting into said tubular sleeve and having an end portion opposite said sleeve connected to said framework.

8. Apparatus for removing anomalies from pipe as defined in claim 3 wherein said scissors expansion mechanism comprises:

a connecting bar positioned between said shoes and extending substantially parallel to the longitudinal axis of each of said semi-cylindrical shoes;

at least two first divergent scissor legs each having one end pivotally connected to said connecting bar for pivotation about a common axis, one of said first scissor legs having its other end pivotally connected to the inner side of one of said semi-cylindrical shoes and the other of said first scissor legs having its other end pivotally connected to the inner side of the other of said semi-cylindrical shoes; and at least two second divergent scissor legs each having one end pivotally connected to said connecting bar for pivotation about a common axis spaced along said connecting bar from said common axis of pivotation of said first legs, one of said second scissor legs having its other end pivotally connected to the inner side of one of said semi-cylindrical shoes with said one second scissor leg extending substantially parallel to said one first scissor leg, and the other of said second scissor legs having its other end pivotally connected to the inner side of the other of said semi-cylindrical shoes, and said other second scissor leg extending substantially parallel to said other first scissor leg.

9. Apparatus for removing anomalies from pipe as defined in claim 1 wherein said force exerting means is further characterized in including:

a transverse reinforcing plate secured inside of each of said shoes along a chordal plane thereof, said transverse reinforcing plates being aligned in a common plane; and a guide plate secured to one of said transverse reinforcing plates and projecting along one side of the other of said transverse reinforcing plates for tracking and guidance thereupon as said shoes are moved divergently from each other with their longitudinal axes retained in substantial parallelism.

10. Apparatus for removing anomalies from pipe as defined in claim 8 wherein said means for supporting an elongated pipe section comprises a plurality of spaced pairs of rollers each mounted for rotation about a horizontally extending axis, with said pairs of rollers mounted on said carriage in horizontally spaced locations over said framework and on said carriage.

11. Apparatus for removing anomalies from pipe as defined in claim 10 and further characterized as including means facilitating reciprocation of said force exerting means along the axis of said pipe section by movement toward and away from the location of said carriage on said framework.

12. Apparatus for restoring pipe to a true cylindrical configuration comprising:

an elongated framework;

carriage means reciprocally mounted on said framework and adapted to support a pipe over said framework for reciprocating movement therealong;

force exerting means supported on said framework in a position to enter said pipe as said pipe is reciprocated, said force exerting means comprising:

a pair of semi-cylindrical shoes;

a scissors expansion mechanism positioned between said shoes and connected to each of said shoes; and means for non-manually expanding said scissors expansion mechanism, said scissors expansion mechanism including:

a connecting bar positioned between said shoes and extending substantially parallel to the longitudinal axis of each of said semi-cylindrical shoes;

at least two first divergent scissor legs each having one end pivotally connected to said connecting bar for pivotation about a common axis, one of said first scissor legs having its other end pivotally connected to the inner side of one of said semi-cylindrical shoes and the other of said first scissor legs having its other end pivotally connected to the inner side of the other of said semi-cylindrical shoes; and at least two second divergent scissor legs each having one end pivotally connected to said connecting bar for pivotation about a common axis spaced along said connecting bar from said common axis of pivotation of said first legs, one of said second scissor legs having its other end pivotally connected to the inner side of one of said semi-cylindrical shoes with said one second scissor leg extending substantially parallel to said one first scissor leg, and the other of said second scissor legs having its other end pivotally connected to the inner side of the other of said semi-cylindrical shoes, and said other second scissor leg extending substantially parallel to said other first scissor leg.

13. Apparatus for removing anomalies from pipe as defined in claim 12 and further characterized as including means facilitating reciprocation of said force exerting means along the axis of said pipe section by movement toward and away from the location of said carriage on said framework.

14. Apparatus for removing anomalies from pipe as defined in claim 13 wherein said means facilitating reciprocation of said force exerting means comprises:

an elongated tubular sleeve connected to said semi-cylindrical shoes;

a rod having one end portion telescoped into said tubular sleeve and having an end portion opposite said sleeve connected to said framework; and means for adjustably interconnecting said tubular sleeve and rod in a pre-selected position relative to each other.

15. Apparatus for removing anomalies from pipe as defined in claim 12 wherein said force exerting means is further characterized as including:

a transverse reinforcing plate secured inside of each of said shoes along a chordal plane thereof, said transverse reinforcing plates being aligned in a common plane; and a guide plate secured to one of said transverse reinforcing plates and projecting along one side of the other of said transverse reinforcing plates for tracking and guidance thereupon as said shoes are moved divergently from each other with their longitudinal axes retained in substantial parallelism.

16. Apparatus for removing anomalies from pipe as defined in claim 15 wherein said means for supporting an elongated pipe section comprises a plurality of spaced pairs of rollers each mounted for rotation about a horizontally extending axis, with said pairs of rollers mounted on said carriage in horizontally spaced locations over said framework and on said carriage.

17. Apparatus for removing anomalies from pipe comprising:

an elongated framework;

carriage means movably mounted on said framework and adapted to support an elongated pipe section over said framework; and force exerting means positioned for partial entry into the interior of a pipe section through an open end thereof as said pipe section is carried on, and reciprocated by, said carriage means, said force exerting means comprising:

a pair of semi-cylindrical shoes in which the individual semi-cylindrical shoes are spaced from each other and are positioned with their longitudinal axes projecting substantially parallel to each other;

means for non-manually divergently moving said shoes with respect to each other while said shoes are inside a pipe section to cause said shoes to exert a radially outwardly acting force on said pipe section by contact of the semi-cylindrical surface of at least one of said shoes with the internal wall of the pipe section;

a transverse reinforcing plate secured inside of each of said shoes along a chordal plane thereof, said transverse reinforcing plates being aligned in a common plane; and a guide plate secured to one of said transverse reinforcing plates and projecting along one side of the other of said transverse reinforcing plates for tracking and guidance thereupon as said shoes are moved divergently from each other with their longitudinal axes retained in substantial parallelism.

18. Apparatus for removing anomalies from pipe as defined in claim 17 and further characterized as including means mounted on said framework for selectively reciprocating said carriage therealong in either of two directions.

19. Apparatus for removing anomalies from pipe as defined in claim 18 and further characterized as including means facilitating reciprocation of said force exerting means along the axis of said pipe section by movement toward and away from the location of said carriage on said framework.

20. Apparatus for removing anomalies from pipe as defined in claim 18 wherein said force exerting means is cantilevered over said framework, and wherein said apparatus is further characterized in including means releasably supporting said force exerting means at a horizontal level facilitating passage of said shoes through the open end of a pipe section advanced along said framework on said carriage.

21. Apparatus for removing anomalies from pipe as defined in claim 20 and further characterized as including means facilitating reciprocation of said force exerting means along the axis of said pipe section by movement toward and away from the location of said carriage on said framework.

22. The method of removing dents from a pipe section having gate fixtures projecting radially outwardly from the outer cylindrical surface of the pipe section comprising the steps of:

supporting the pipe section for free rotational movement through 360° about its longitudinal axis;

reciprocating the pipe section while so supported to a position at which the pipe section surrounds and encloses a pair of semi-cylindrical shoes each having semi-cylindrical surfaces oriented to bear against a portion of the internal wall of the pipe section when the shoes are moved apart from each other and into contact with the pipe section;

rotating the pipe section as needed to bring dents in the pipe section to a position to be contacted by the semi-cylindrical surface of at least one of said shoes when said shoes are moved apart from each other; and non-manually moving the semi-cylindrical shoes apart from each other and into forceable contact with the internal wall of the pipe section to force the dents in said pipe section outwardly.

23. The method defined in claim 22 and further characterized by the additional steps of:

reciprocating the pipe section while said shoes are moved apart from each other and into contact with the internal wall of the pipe section to pull the shoes along the longitudinal axis of the pipe section in one direction; then moving the shoes toward each other and out of engagement with the pipe section; and finally reciprocating the pipe section in the opposite direction from said last-mentioned reciprocation and relative to said shoes to position a selected portion of said pipe section around said shoes.

* * * * *